US008400378B2

(12) United States Patent
Kim et al.

(10) Patent No.: US 8,400,378 B2
(45) **Date of Patent: *Mar. 19, 2013**

(54) ELECTRO-LUMINESCENCE PIXEL, PANEL WITH THE PIXEL, AND DEVICE AND METHOD FOR DRIVING THE PANEL

(75) Inventors: In Hwan Kim, Seoul (KR); Seung Chan Byun, Seoul (KR); Jin Chul Choi, Gunpo-si (KR); Jin Hyoung Kim, Goyang-si (KR); Sang Keun Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/415,462

(22) Filed: Mar. 8, 2012

(65) Prior Publication Data

US 2012/0162052 A1 Jun. 28, 2012

Related U.S. Application Data

(62) Division of application No. 12/005,625, filed on Dec. 28, 2007, now Pat. No. 8,154,479.

(30) Foreign Application Priority Data

Dec. 29, 2006 (KR) ..... 10-2006-0138744

(51) Int. Cl.
*G09G 3/30* (2006.01)

(52) U.S. Cl. ..... 345/76; 345/77

(58) Field of Classification Search ..... 345/76–78, 345/82, 84; 315/169.3
See application file for complete search history.

(56) References Cited

U.S. PATENT DOCUMENTS

| | | | |
|---|---|---|---|
| 7,403,179 | B2 | 7/2008 | Koyama et al. |
| 7,517,551 | B2 | 4/2009 | Arai |
| 2003/0184568 | A1 | 10/2003 | Date et al. |
| 2005/0012736 | A1 | 1/2005 | Uchino et al. |
| 2005/0140308 | A1 | 6/2005 | Park |
| 2006/0176252 | A1 | 8/2006 | Date et al. |
| 2007/0222732 | A1 | 9/2007 | Kageyama et al. |
| 2007/0279403 | A1 | 12/2007 | Uchino et al. |

*Primary Examiner* — Ricardo L Osorio
(74) *Attorney, Agent, or Firm* — McKenna Long & Aldridge, LLP

(57) ABSTRACT

An electro-luminescence display having a plurality of pixels is disclosed. One of the pixels of the electro-luminescence display includes an electro-luminescence diode electrically connected between first and second voltage sources; first and second thin film transistors adjusting an amount of current flowing to the electro-luminescence diode; and a control circuit complementarily operating the first and second thin film transistors in an active mode and a refresh mode.

5 Claims, 8 Drawing Sheets

ELECTRO-LUMINESCENCE PIXEL, PANEL WITH THE PIXEL, AND DEVICE AND METHOD FOR DRIVING THE PANEL

CROSS-REFERENCE TO RELATED APPLICATIONS

This application is a Divisional of application Ser. No. 12/005,625 filed Dec. 28, 2007 now U.S. Pat. No. 8,154,479, now allowed, which claims priority to Korean Patent Application No. 10-2006-0138744, filed Dec. 29, 2006, all of which are hereby incorporated by reference for all purposes as if fully set forth herein.

BACKGROUND OF THE INVENTION

1. Field of the Invention

The present invention relates to an electro-luminescence display, and more particularly, to an electro-luminescence display with an array of electro-luminescence diodes and a method for driving the same.

2. Discussion of the Related Art

Flat panel displays include liquid crystal displays, electro-luminescence displays, and plasma display panels. Flat panel displays are slim and light, and it is easy to manufacture flat panel displays with a large screen size. Therefore, flat panel displays are widely used for computer systems, television sets, and mobile communication devices in replace of cathode ray tubes. Electro-luminescence displays are widely used because they have a wide viewing angle and do not require an additional light source.

An electro-luminescence display includes a plurality of electro-luminescence pixels arranged in the form of an active matrix. Each electro-luminescence pixel emits light according to the voltage or current level of a pixel data signal. To respond to the pixel data signal, each electro-luminescence pixel includes an electro-luminescence diode ELD and a first thin film transistor MT1 that are connected in series between first and second voltage supply lines VDD and VSS, as illustrated in FIG. 1. The first thin film transistor MT1 is used to adjust an amount of current supplied from the first voltage supply line VDD to the electro-luminescence diode ELD in response to a voltage level at a control node CN. The electro-luminescence diode ELD displays a dot of an image by emitting light in proportion to an amount of current supplied from the first voltage supply line VDD.

Referring to FIG. 1, the electro-luminescence pixel further includes a second thin film transistor MT2 connected to a gate line GL, a data line DL and the control node CN, and a storage capacitor Cst connected between the control node CN and the second voltage supply line VSS. The second thin film transistor MT2 is turned on in response to a gate signal from the gate line GL to transmit a pixel data signal from the data line DL to the control node CN. The storage capacitor Cst is used to maintain the voltage level of the pixel data signal supplied to the control node CN. Therefore, the voltage level of the storage capacitor Cst is renewed every time the second thin film transistor MT2 is turned on. Due to the storage capacitor Cst, the first thin film transistor MT1 can continuously operate to display a dot of an image for a predetermined time.

As explained above, in the electro-luminescence pixel of the related art, the first thin film transistor MT1 continuously operates to control the amount of current applied to the electro-luminescence diode ELD during a period when the ELD displays a dot of an image. This continuous operation of the first thin film transistor MT1 results in stresses on the first thin film transistor MT1, thereby damaging the first thin film transistor MT1. In this case, the luminous output of the electro-luminescence diode ELD, which is proportional to the amount of current applied to the electro-luminescence diode ELD, may not correspond to the pixel data signal. As a result, a residual image may be present on the electro-luminescence display.

Moreover, the second thin film transistor MT2 may also be damaged by the continuous operation. Thus the life spans of the first and second thin film transistors MT1 and MT2 and the electro-luminescence display may decrease.

SUMMARY OF THE INVENTION

Accordingly, the present invention is directed to an electro-luminescence display and a method for driving the same that substantially obviate one or more problems due to limitations and disadvantages of the related art.

An advantage of the present invention is to provide an electro-luminescence display with a long life span, and a method for driving the same.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the invention, as embodied and broadly described herein, an electro-luminescence display having a plurality of pixels, one of the pixels of the display includes an electro-luminescence diode electrically connected between first and second voltage sources; first and second thin film transistors adjusting an amount of current flowing to the electro-luminescence diode; and a control circuit complementarily operating the first and second thin film transistors in an active mode and a refresh mode.

In another aspect of the present invention, a method of driving an electro-luminescence display having a plurality of pixels, each pixel including an electro-luminescence diode includes applying an image signal to a first data line; applying a first scan signal to a first gate line; and complementarily operating first and second thin film transistors that adjust an amount of light generated from the electro-luminescence diode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
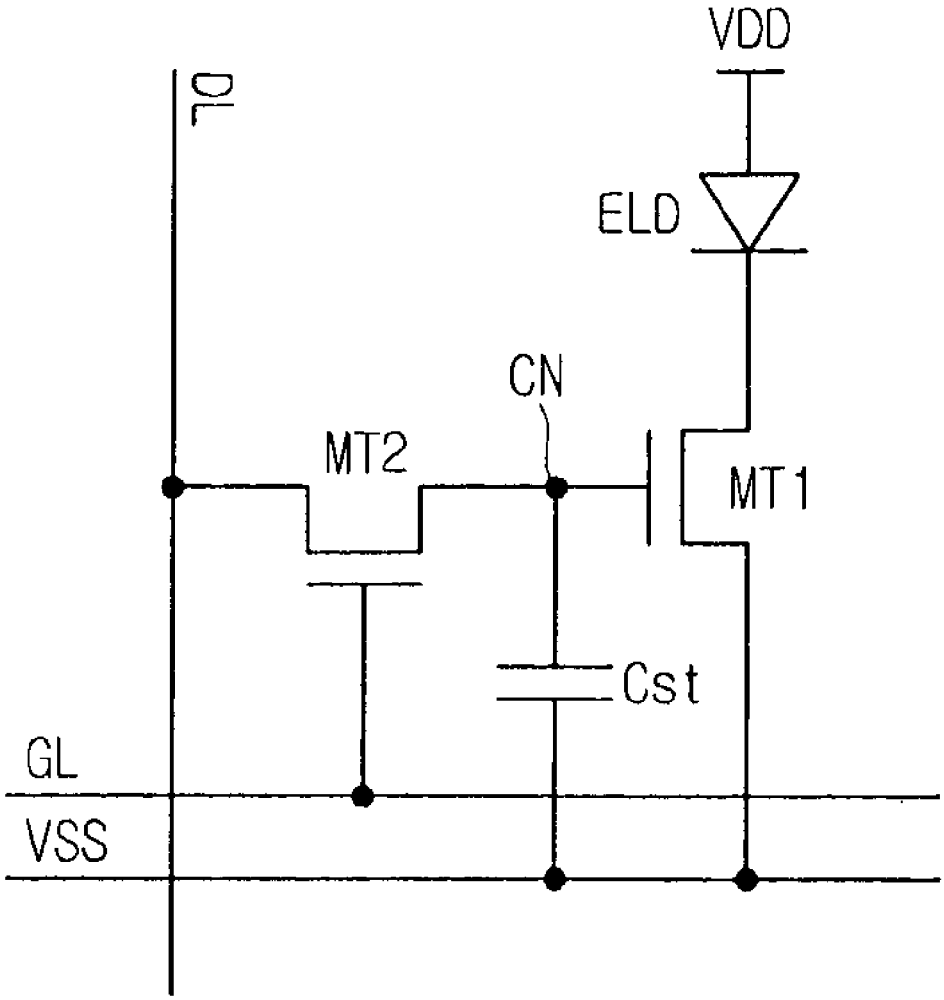
FIG. 1 is a circuit diagram for explaining an electro-luminescence pixel according to the related art.
Figure 2:
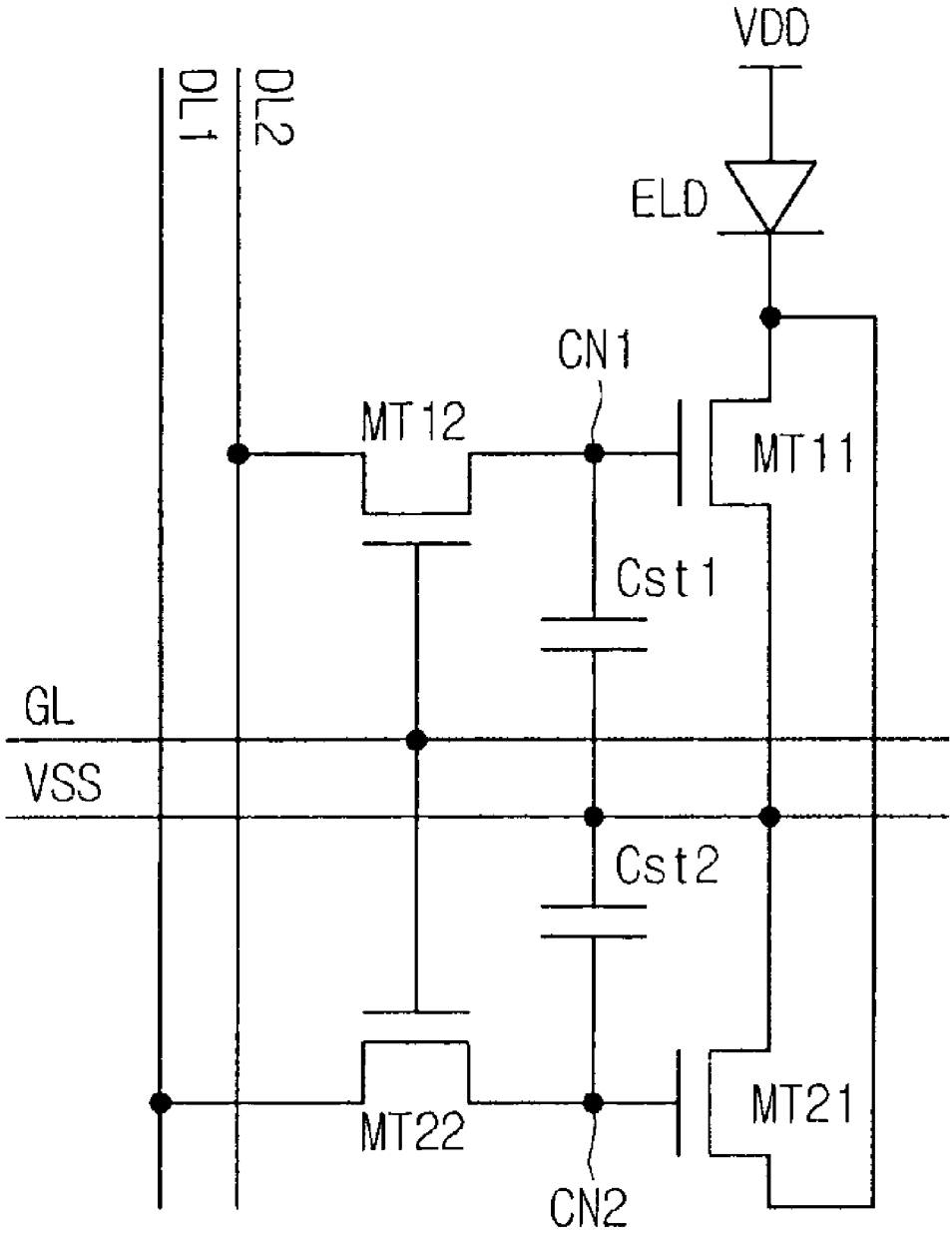
FIG. 2 is a circuit diagram for explaining an electro-luminescence pixel according to an embodiment of the present invention.

FIG. 2 is a circuit diagram for explaining an electro-luminescence pixel according to an embodiment of the present invention.

Referring to FIG. 2, the electro-luminescence pixel includes an electro-luminescence diode ELD connected between first and second voltage supply lines VDD and VSS, and first and second thin film transistors MT11 and MT21 connected in parallel between the second voltage supply line VSS and the electro-luminescence diode ELD. A high voltage is supplied to the first voltage supply line VDD, and a low voltage is supplied to the second voltage supply line VSS.

In response to a voltage level at a first control node CN1, the first thin film transistor MT11 adjusts an amount of current supplied from the first voltage supply line VDD to the electro-luminescence diode ELD. Similarly, the second thin film transistor MT21 adjusts the amount of current supplied from the first voltage supply line VDD to the electro-luminescence diode ELD in response to a voltage level at a second control node CN2. The electro-luminescence diode ELD displays a dot of an image by emitting light in proportion to the amount of current received from the first voltage supply line VDD.

The electro-luminescence pixel further includes a third thin film transistor MT12 connected to a second data line DL2, a gate line GL and the first control node CN1, and a first storage capacitor Cst1 connected between the first control node CN1 and the second voltage supply line VSS.

The third thin film transistor MT12 is turned on in response to a gate signal from the gate line GL to transmit a first pixel data signal from the second data line DL2 to the first control node CN1. The first storage capacitor Cst1 is used to maintain the voltage level of the first pixel data signal supplied to the first control node CN1. The voltage level of the first storage capacitor Cst1 is renewed each time when the third thin film transistor MT12 is turned on.

The first thin film transistor MT11 selectively operates according to the voltage level of the first storage capacitor Cst1. For example, when the voltage level of the first pixel data signal supplied to the first control node CN1 is higher than a threshold voltage (e.g., 0.7 V), the first thin film transistor MT11 adjusts the amount of current flowing from the first voltage supply line VDD to the second voltage supply line VSS through the electro-luminescence diode ELD and a channel between source and drain terminals of the first thin film transistor MT11. Here, the first thin film transistor MT11 adjusts the amount of current according to the voltage level of the first pixel data signal. In other words, the amount of current supplied from the first voltage supply line VDD to the electro-luminescence diode ELD corresponds to or is proportional to the voltage level at the first control node CN1 due to the first thin film transistor MT11.

On the other hand, when the first pixel data signal supplied to the first control node CN1 has a voltage level having a negative polarity, the first thin film transistor MT11 is turned off, and the channel of the first thin film transistor MT11 is refreshed. In other words, the first thin film transistor MT11 switches between active (operation) mode and refresh mode according to the first pixel data signal applied to the first control node CN1. When the first thin film transistor MT11 operates in the active mode, the amount of current supplied to the electro-luminescence diode ELD is adjusted according to the voltage level of the first pixel data signal.

As a result, the third thin film transistor MT12 and the first storage capacitor Cst1 form a first operation mode controller that controls the first thin film transistor MT11 to operate in one of the active and refresh modes.

The electro-luminescence pixel of FIG. 2 further includes a fourth thin film transistor MT22 connected to a first data line DL1, the gate line GL and a second control node CN2, and a second storage capacitor Cst2 connected between the second control node CN2 and the second voltage supply line VSS.

The fourth thin film transistor MT22 is turned on or off together with the third thin film transistor MT12 in response to a gate signal from the gate line GL. When the fourth thin film transistor MT22 is turned on, a second pixel data signal is transmitted from the first data line DL1 to the second control node CN2 through the fourth thin film transistor MT22. The second storage capacitor Cst2 is used to maintain the voltage level of the second pixel data signal supplied to the second control node CN2. The voltage level of the second storage capacitor Cst2 is renewed each time when the fourth thin film transistor MT22 is turned on.

The second thin film transistor MT21 selectively operates according to the voltage level of the second storage capacitor Cst2. For example, when the voltage level of the second pixel data signal supplied to the second control node CN2 is higher than a threshold voltage (e.g., 0.7 V), the second thin film transistor MT21 adjusts the amount of current flowing from the first voltage supply line VDD to the second voltage supply line VSS through the electro-luminescence diode ELD and a channel between source and drain terminals of the second thin film transistor MT21. Here, the second thin film transistor MT21 adjusts the amount of current according to the voltage level of the second pixel data signal. In other words, the amount of current supplied from the first voltage supply line VDD to the electro-luminescence diode ELD is corresponding to or proportional to the voltage level of the second control node CN2 owing to the second thin film transistor MT21.

On the other hand, when the second pixel data signal supplied to the second control node CN2 has a voltage level having a negative polarity, the second thin film transistor MT21 is turned off, and the channel of the second thin film transistor MT21 is refreshed. In other words, the second thin film transistor MT21 switches between active mode and refresh mode according to the second pixel data signal applied to the second control node CN2. When the second thin film transistor MT21 operates in the active mode, the amount of current supplied to the electro-luminescence diode ELD is adjusted according to the voltage level of the second pixel data signal.

As a result, the fourth thin film transistor MT22 and the second storage capacitor Cst2 form a second operation mode controller that controls the second thin film transistor MT21 to operate in one of the active and refresh modes.

Figure 3:
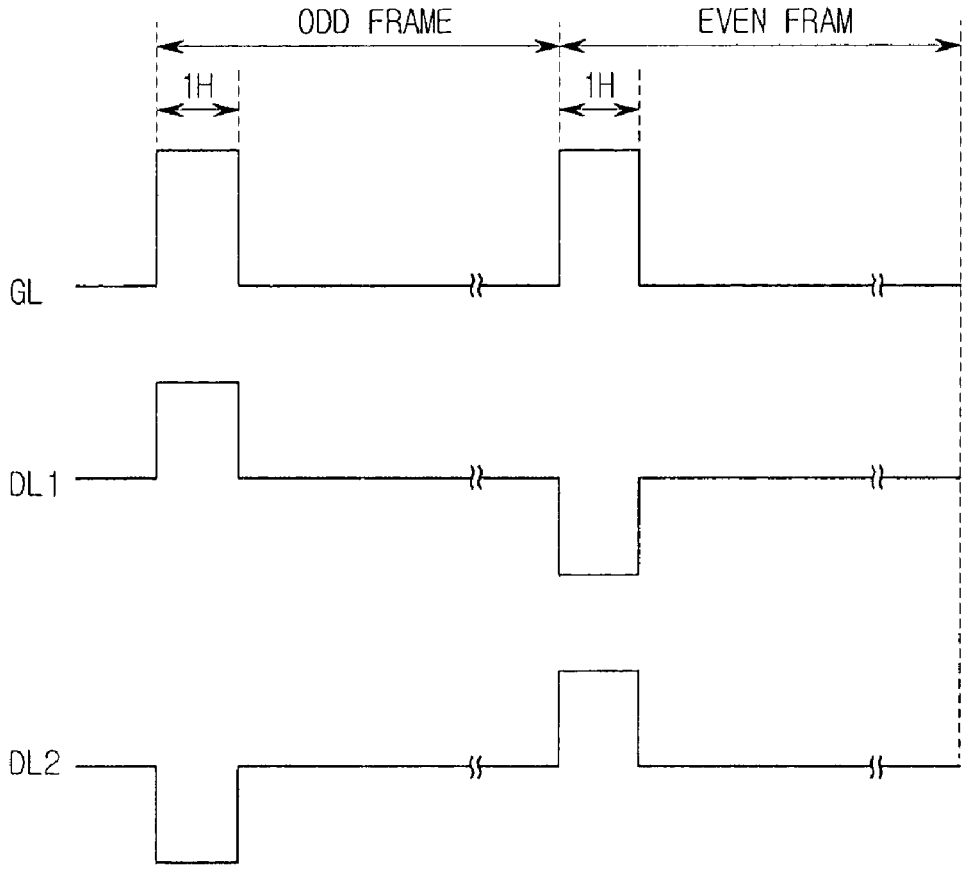
FIG. 3 is a timing chart for explaining operation timing of the electro-luminescence pixel of FIG. 2.

Referring to FIG. 3, the first pixel data signal, which is supplied from the second data line DL2 and charges the first storage capacitor Cst1, has a polarity opposite to that of the second pixel data signal, which is supplied from the first data line DL1 and charges the second storage capacitor Cst2. Furthermore, the pulses of the first and second pixel data signals are simultaneously transmitted to the second and first data lines DL1 and DL2 when the gate line GL is enabled by a high voltage during a given frame period. In addition, the polarities of the first and second pixel data signals switch on a frame-by-frame basis or a predetermined number of frames (e.g., 30 or 60 frames).

Accordingly, the first and second thin film transistors MT11 and MT21 operate in the active and refresh modes in a complementary manner. That is, when the first thin film transistor MT11 operates in the active mode, the second thin film transistor MT21 operates in the refresh mode, and when the first thin film transistor MT11 operates in the refresh mode, the second thin film transistor MT21 operates in the active mode. Therefore, an amount of current may be continuously supplied to the electro-luminescence diode ELD, and the amount of current applied to the electro-luminescence diode ELD may be precisely controlled according to the voltage levels of the first and second pixel data signals.

Due to the complementary operation of the first and second thin film transistors MT11 and MT21, the first and second thin film transistors MT11 and MT21 are less stressed. As a result, the first and second thin film transistors MT11 and MT21, and the electro-luminescence pixel including the first and second thin film transistors MT11 and MT21 may have long life spans. Furthermore, a durable electro-luminescence display may be provided by driving the plurality of electro-luminescence pixels in this manner.

Figure 4:
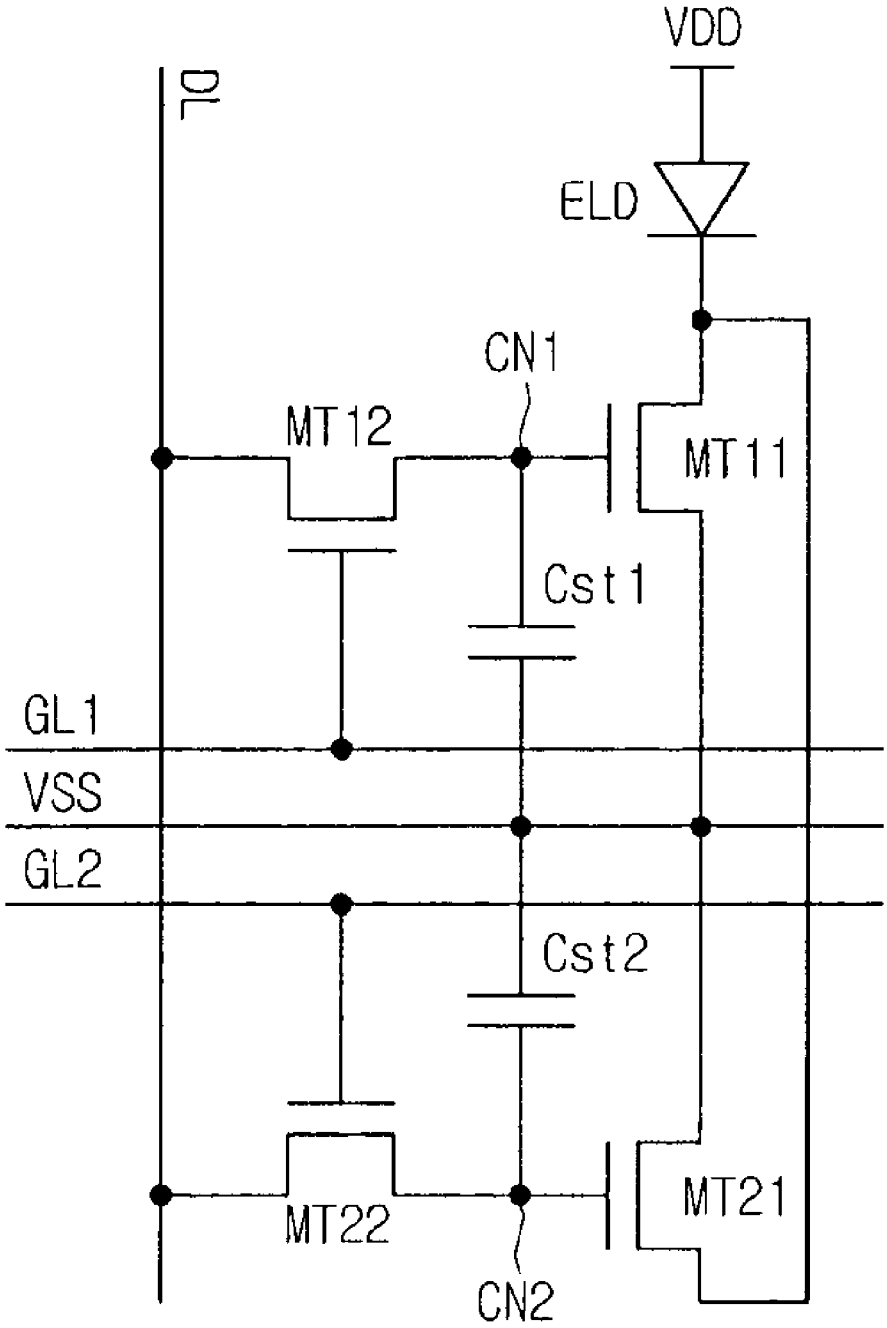
FIG. 4 is a circuit diagram for explaining an electro-luminescence pixel according to another embodiment of the present invention.

FIG. 4 is a circuit diagram for explaining an electro-luminescence pixel according to another embodiment of the present invention.

Referring to FIG. 4, the electro-luminescence pixel includes third and fourth thin film transistors MT12 and MT22. The third and fourth thin film transistors MT12 and MT22 are connected to the same data line DL and are configured to operate in response to gate signals from first and second gate lines GL1 and GL2, respectively. Other structures of the electro-luminescence pixel of FIG. 4 are the same as those of the electro-luminescence pixel of FIG. 2. In FIGS. 2 and 4, like reference numerals denote like elements, and thus their description will be omitted.

The first and second gate lines GL1 and GL2 are sequentially enabled during a predetermined period (e.g., a horizontal synchronization signal period) of each frame. The polarity of a pixel data signal of the data line DL switches from positive to negative (or negative to positive) according to the gray scale of a pixel image as the first and second gate lines GL1 and GL2 are enabled in turn in a predetermined period. Also, the order of positive and negative polarity voltage levels of the pixel data signal varies from frame to frame. If the pixel data signal has a positive polarity voltage level prior to a negative polarity voltage level at an odd frame, the pixel data signal has a negative polarity voltage level prior to a positive polarity voltage level at an even frame. The complementary driving method disclosed above in this embodiment is applied to the electro-luminescent pixel on a frame-by-frame basis.

Figure 5A:
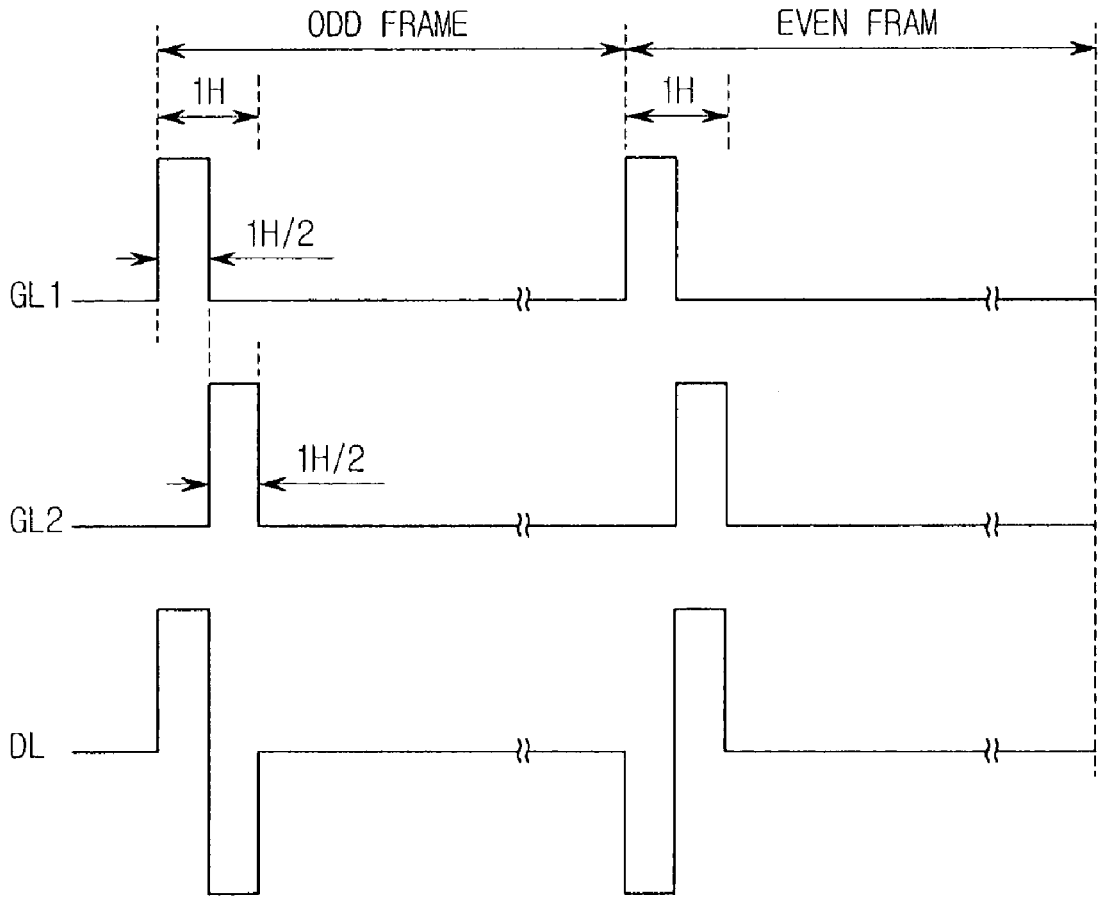
FIGS. 5A and 5B are timing charts for explaining operation timing of the electro-luminescence pixel of FIG. 4.

Referring to FIG. 5A, the first and second gate lines GL1 and GL2 are enabled in turn for half of the period of a horizontal synchronization signal (half of one horizontal synchronization signal period) by a high voltage. During an odd frame, a pixel data signal of the data line DL has a positive polarity voltage level when the first gate line GL1 is enabled and a negative polarity voltage level when the second gate line GL2 is enabled. On the other hand, during an even frame, the pixel data signal of the data line DL has a positive polarity voltage level when the first gate line GL1 is enabled and a negative polarity voltage level when the second gate line GL2 is enabled.

Alternatively, the first and second gate lines GL1 and GL2 may be sequentially enabled for different time durations during one horizontal synchronization period of each frame. The enable times of the first and second gate lines GL1 and GL2 vary from frame to frame. Furthermore, when one of the first and second gate lines GL1 and GL2 is enabled for a long time, the pixel data signal of the data line DL may have a positive polarity voltage level corresponding to the gray scale of video data. On the other hand, when one of the first and second gate lines GL1 and GL2 is enabled for a short time, the pixel data signal may have a negative polarity voltage level.

Figure 5B:
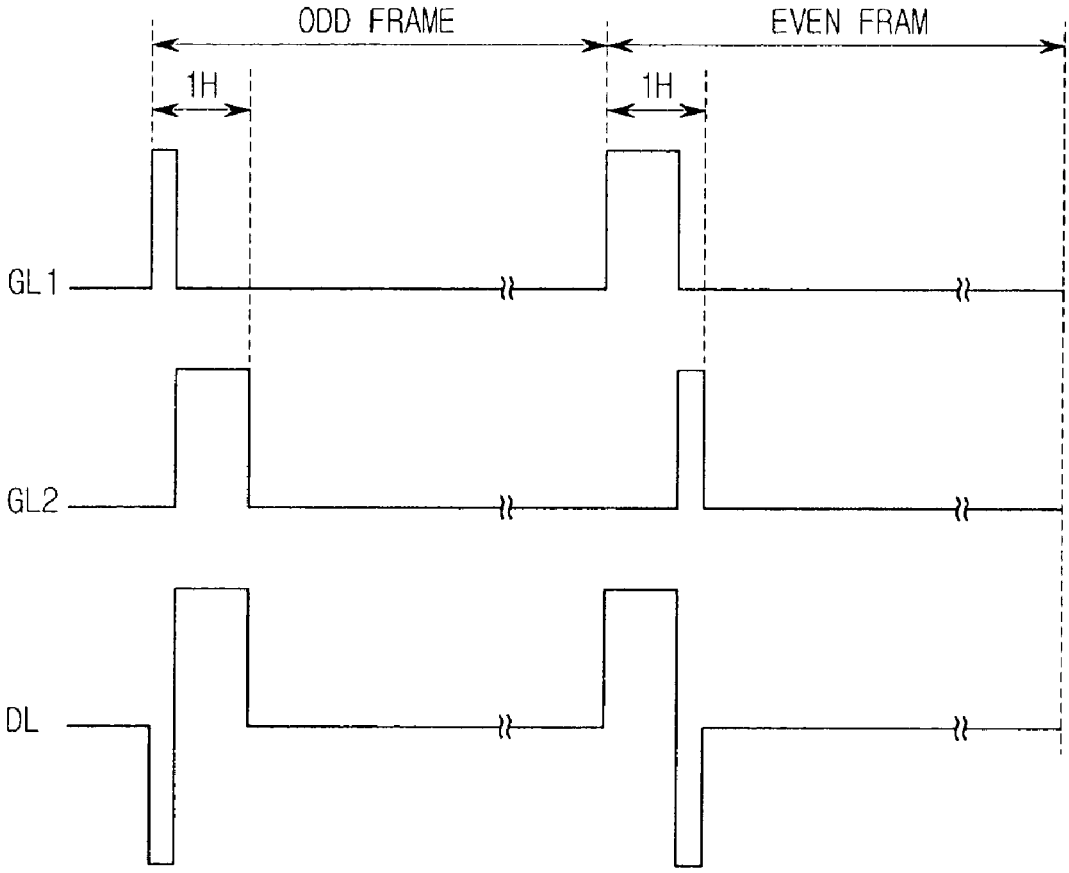

Referring to FIG. 5B, during an odd frame, the first gate line GL1 is first enabled by a high voltage for a first duration (short) equal to or less than half the period of a horizontal synchronization signal, and then the second gate line GL2 is enabled by a high voltage for a second duration (long) equal to or greater than half the period of the horizontal synchronization signal. On the other hand, during an even frame, the first gate line GL1 is enabled for the second duration (long), and then the second gate line GL2 is enabled for the first duration (short). Therefore, when the first gate line GL1 is enabled for the first duration during an odd frame, the pixel data signal of the data line DL has a negative polarity voltage level, and when the second gate line GL2 is enabled for the second duration during the odd frame, the pixel data signal has a positive polarity voltage level. On the other hand, when the first gate line GL1 is enabled for the second duration during an even frame, the pixel data signal of the data line DL has a positive polarity voltage level, and when the second gate line GL2 is enabled for the first duration during the even frame, the pixel data signal has a negative polarity voltage level. The negative polarity voltage level of the pixel data signal may be either a predetermined voltage level or a voltage level corresponding to the gray scale of a pixel image as in the positive polarity voltage level of the pixel image. The first duration (short) is beneficially in a range between about 20% to about 40% of the period of a horizontal synchronization signal, while the second duration (long) is the rest of the period of a horizontal synchronization signal. More beneficially, the first duration is about three-tenth of the period of a horizontal synchronization signal.

When the first and second gate lines GL1 and GL2 are sequentially enabled, the first storage capacitor Cst1 is charged by the positive or negative polarity voltage level of the pixel data signal transmitted from the data line DL through the third thin film transistor MT12, and the second storage capacitor Cst2 is charged by the negative or positive polarity voltage level of the pixel data signal transmitted from the data line DL through the fourth thin film transistor MT22.

Therefore, opposite polarity voltage levels of the pixel data signal are applied to the first and second control nodes CN1 and CN2, respectively. The first thin film transistor MT11 operates in the active and refresh modes in turn during each frame according to the voltage level of the first storage capacitor Cst1. For example, when the voltage level of the pixel data signal supplied to the first control node CN1 is higher than a threshold voltage (e.g., 0.7 V), the first thin film transistor MT11 adjusts the amount of current flowing from the first voltage supply line VDD to the second voltage supply line VSS through the electro-luminescence diode ELD and a channel between source and drain terminals of the first thin film transistor MT11. Here, the first thin film transistor MT11 adjusts the amount of current according to the voltage level of the pixel data signal. In other words, the amount of current supplied from the first voltage supply line VDD to the electro-luminescence diode ELD corresponds to or is proportional to the voltage level of the first control node CN1 due to the first thin film transistor MT11. On the other hand, when the pixel data signal supplied to the first control node CN1 has a negative polarity voltage level, the first thin film transistor MT11 is turned off, and the channel of the first thin film transistor MT11 is refreshed.

Similarly, the second thin film transistor MT21 operates in the opposite operation mode to that of the first thin film transistor MT11 according to the voltage level of the second storage capacitor Cst2. For example, when the voltage level of the pixel data signal supplied to the second control node CN2 is higher than a threshold voltage (e.g., 0.7 V), the second thin film transistor MT21 adjusts the amount of current flowing from the first voltage supply line VDD to the second voltage supply line VSS through the electro-luminescence diode ELD and a channel between source and drain terminals of the second thin film transistor MT21. Here, the second thin film transistor MT21 adjusts the amount of the current according to the voltage level of the pixel data signal. In other words, the amount of current supplied from the first voltage supply line VDD to the electro-luminescence diode ELD corresponds to or is proportional to the voltage level of the second control node CN2 due to the second thin film transistor MT21. On the other hand, when the pixel data signal supplied to the second control node CN2 has a negative polarity voltage level, the second thin film transistor MT21 is turned off, and the channel of the second thin film transistor MT21 is refreshed.

Because the first and second thin film transistors MT11 and MT21 operate in the active and refresh modes in a complementary manner as described above, an amount of current may be continuously supplied to the electro-luminescence diode ELD, and the amount of current may be precisely controlled according to the voltage level of the pixel data signal. The first and second thin film transistors MT11 and MT21 are thus less stressed because of the complementary operation of the first and second thin film transistors MT11 and MT21. As a result, the first and second thin film transistors MT11 and MT21, and the electro-luminescence pixel including the first and second thin film transistors MT11 and MT21 may have long life spans. Furthermore, a durable electro-luminescence display can be provided by driving the plurality of electro-luminescence pixels in this manner.

In the first and second embodiments described above, NMOS transistors are used for the first and second thin film transistors MT11 and MT21 to adjust an amount of current supplied to the electro-luminescence diode. However, it should be appreciated that PMOS transistors may also be used for the first and second thin film transistors MT11 and MT21.

Figure 6:
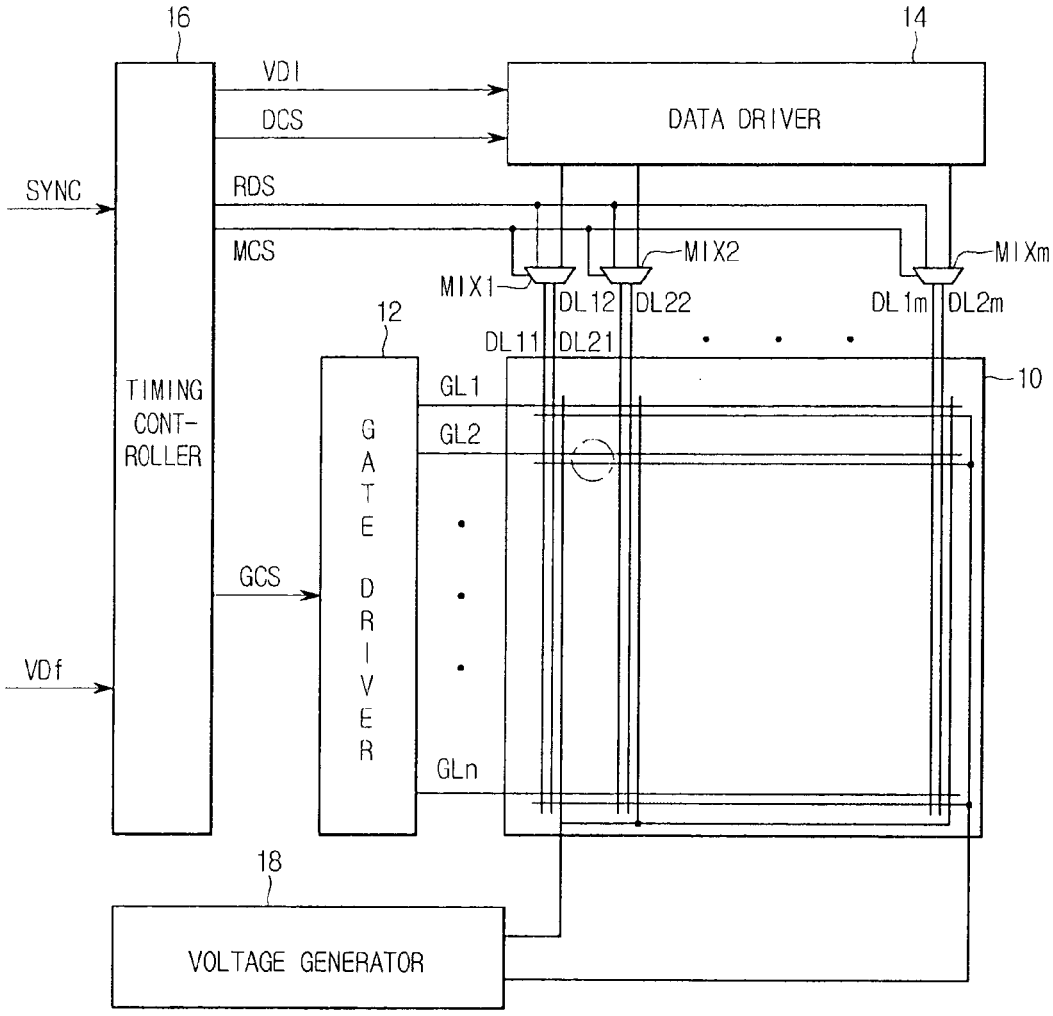
FIG. 6 is a schematic block diagram for explaining an organic electro-luminescence display according to an embodiment of the present invention.

FIG. 6 is a schematic block diagram for explaining an organic electro-luminescence display according to an embodiment of the present invention.

Referring to FIG. 6, the electro-luminescence display includes a gate driver 12 and a data driver 14. The gate driver 12 drives 11 gate (or scan) lines GL1 to GLn of an electro-luminescence panel 10, and the data driver 14 drives m pairs of data (or source) lines DL11 to DL2*m* of the electro-luminescence panel 10. The electro-luminescence panel 10 is divided into m×n regions by the n gate lines GL1 to GLn and the m pairs of data lines DL11 to DL2*m*. In each region of the electro-luminescence panel 10, an electro-luminescence pixel such as the electro-luminescence pixel of FIG. 2 is formed.

The gate driver 12 operates in a manner such that the n gate lines GL1 to GLn of the electro-luminescence panel 10 are sequentially enabled for a predetermined time (e.g., one horizontal synchronization signal period) during each frame (each vertical synchronization signal period). For this, the gate driver 12 operates in response to a gate control signal GCS. The gate control signal GCS includes a gate start pulse occurring at the beginning of a frame and at least one clock signal swinging at each period of the horizontal synchronization signal. Each time one of the n gate lines GL1 to GLn is enabled (i.e., at each period of the horizontal synchronization signal), the data driver 14 generates pixel data signals corresponding to a line of an image for the m pairs of data lines DL11 to DL2*m*.

The data driver 14 receives a line of pixel data VDl corresponding to a line of an image in response to a data control signal DCS. Then, the data driver 14 converts the line of pixel data VDl into analog pixel data signals. In this way, m pixel data signals are generated and output through m output channels of the data driver 14.

The electro-luminescence display further includes m duplex mixers MIX1 to MIXm connected between the m output channels of the data driver 14 and the m pairs of data lines DL11 to DL2*m*, respectively. A refresh data signal RDS is commonly input to the m duplex mixers MIX1 to MIXm for maintaining a negative polarity voltage level of a constant level. The m duplex mixers MIX1 to MIXm operate in response to a mix control signal MCS having a logic level varying on a frame-by-frame basis or a predetermined number of frames (e.g., 30 or 60 frames) so that a pixel data signal from a corresponding output channel of the data driver 14 and the refresh data signal RDS may be alternately supplied to a corresponding pair of the data lines DL1*x* and DL2*x* of the electro-luminescence panel 10 during each frame or a predetermined number of frames. For example, when the mix control signal MCS has a predetermined logic level (i.e., a high logic level), the m duplex mixers MIX1 to MIXm allow pixel data signals to be supplied to odd data lines DL1*x* from corresponding output channels of the data driver 14, and the m duplex mixers MIX1 to MIXm allow the refresh data signal RDS to be transmitted to even data lines DL2*x*. On the other hand, when the mix control signal MCS has a base logic level (i.e., a low logic level), the m duplex mixers MIX1 to MIXm allow pixel data signals to be supplied to even data lines DL2*x* from corresponding output channels of the data driver 14, and the m duplex mixers MIX1 to MIXm allow the refresh data signal RDS to be transmitted to odd data lines DL1*x*. Due to the m duplex mixers MIX1 to MIXm, the first and second thin film transistors MT11 and MT21 in each electro-luminescence pixel of the electro-luminescence panel 10 may operate in the active and refresh modes in a complementary manner during each frame or a predetermined number of frames.

As a result, the electro-luminescence diode ELD of the electro-luminescence pixel continuously emits light according to the gray scale of a pixel image, without the first and second thin film transistors MT11 and MT21 being damaged in a short time. Therefore, the electro-luminescence panel 10 and the electro-luminescence display may have longer life spans. Furthermore, a residual image is not present or reduced on the electro-luminescence panel 10.

The electro-luminescence display further includes a timing controller 16 and a voltage generator 18. The timing controller 16 controls operation timing of the gate driver 12, the data driver 14, and the m duplex mixers MIX1 to MIXm. The voltage generator 18 generates voltages for driving electro-luminescence pixels of the electro-luminescence panel 10.

The timing controller 16 generates gate control signals GCSs, data control signals DCSs, and mix control signal MCSs using synchronization signals SYNCs received from an external unit (e.g., a graphic module of a computer system or an image modulation module of a television set). Furthermore, the timing controller 16 can receive frame pixel date VDf for each image frame from the external unit.

The frame pixel data VDf is divided into sets of a line of pixel data VDl corresponding to sets of a line of an image. The line of pixel data VDl is supplied to the data driver 14. The timing controller 16 generates the refresh data signal RDS and supplies the refresh data signal RDS to the m duplex mixers MIX1 to MIXm for maintaining a negative polarity voltage level of a constant level.

The voltage generator 18 generates a first supply voltage having a high potential level and a second supply voltage having a low potential level for driving the electro-luminescence pixels of the electro-luminescence panel 10. The first supply voltage is commonly supplied to the electro-luminescence pixels of the electro-luminescence panel 10 through first voltage supply lines VDDs, and the second supply voltage is commonly supplied to the electro-luminescence pixels of the electro-luminescence panel 10 through second voltage supply lines VSSs.

Figure 7:
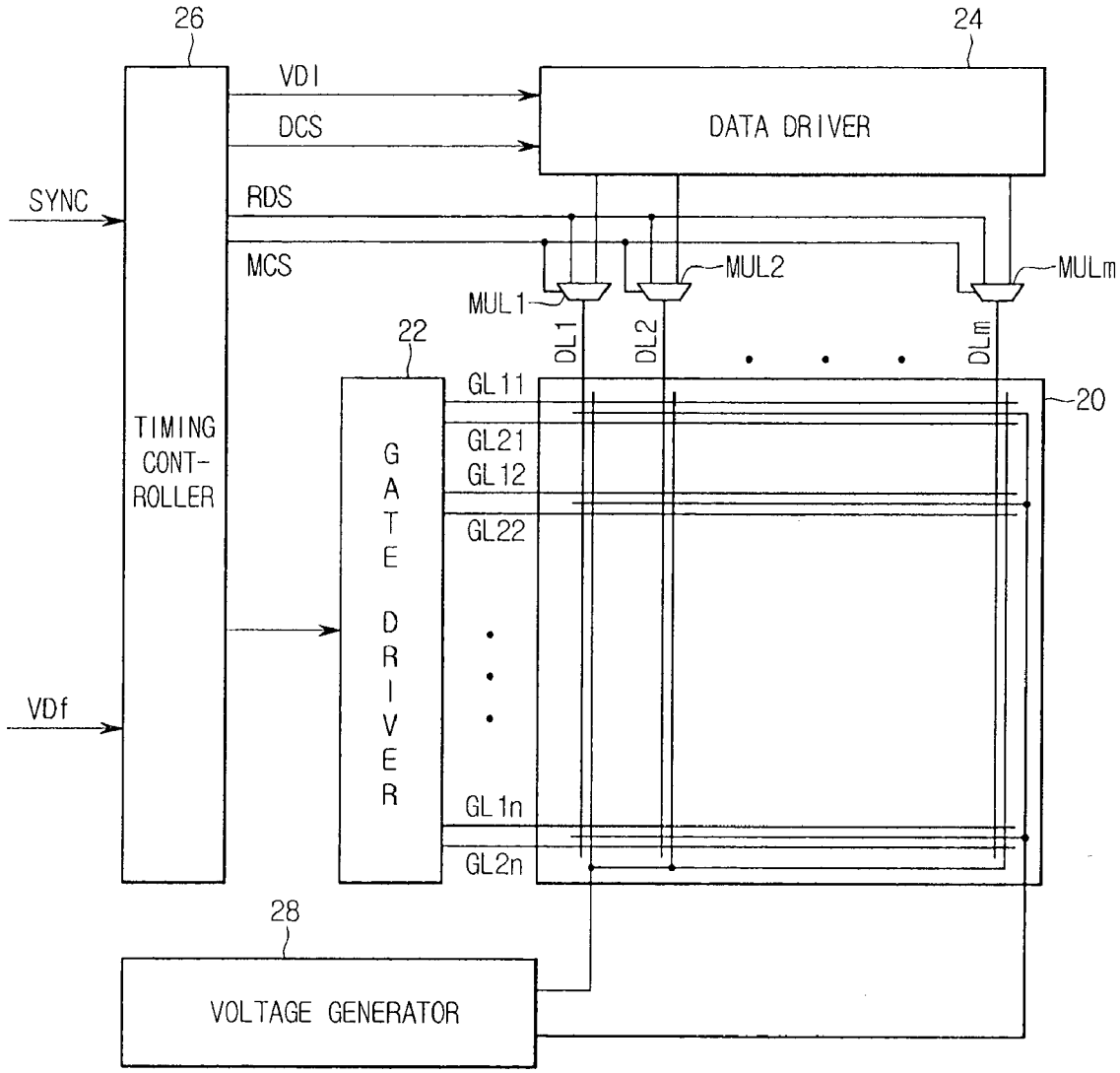
FIG. 7 is a schematic block diagram for explaining an organic electro-luminescence display according to another embodiment of the present invention.

FIG. 7 is a schematic block diagram for explaining an organic electro-luminescence display according to another embodiment of the present invention.

Referring to FIG. 7, the electro-luminescence display includes a gate driver 22 and a data driver 24. The gate driver 12 drives n pairs of gate (or scan) lines GL11 to GL2*n* of an electro-luminescence panel 20, and the data driver 14 drives m data (or source) lines DL1 to DLm of the electro-luminescence panel 20. The electro-luminescence panel 20 is divided into m×n regions by the n pairs of gate lines GL11 to GL2*n* and the m data lines DL1 to DLm. In each region of the electro-luminescence panel 20, an electro-luminescence pixel such as the electro-luminescence pixel of FIG. 4 is formed.

The gate driver 22 operates in a manner such that the 2n gate lines GL11 to GL2*n* of the electro-luminescence panel 20 may be sequentially enabled for a predetermined time (e.g., the half of a horizontal synchronization signal period) during each frame (each vertical synchronization signal period). For example, odd gate lines GL1*x* of the gate lines GL11 to GL2*n* are first enabled, and even gate lines GL2*x* of the gate lines GL11 and GL2*n* are then enabled during the horizontal scan periods. For this, the gate driver 22 operates in response to a gate control signal GCS. The gate control signal GCS includes a gate start pulse occurring at the beginning of a frame and at least one clock signal swinging at each half of the period of the horizontal synchronization signal.

Alternatively, the gate driver 22 may sequentially enable n pairs of gate lines (i.e., the 2n gate lines GL11 to GL2*n*) for different time durations during one horizontal synchronization period on a frame-by-frame basis. For example, during an odd frame, the gate driver 22 enables the odd gate lines GL11 to GL1*n* for a first duration and enables the even gate lines GL21 to GL2*n* for a second duration. Also, during an even frame, the gate driver 22 enables the odd gate lines GL11 to GL1*n* for the second duration and enables the even gate lines GL21 to GL2*n* for the first duration. The first duration corresponds to half the horizontal synchronization period or less, and the second duration corresponds to the remaining of the horizontal synchronization period not including the first duration. In order to sequentially enable the 2n gate lines GL11 to GL2*n*, the gate driver 22 operates in response to the gate control signal GCS.

The gate control signal GCS includes first and second gate start pulses at the beginning of a frame, and at least one clock signal swinging at each period of a horizontal synchronization signal. The first gate start pulses have a phase corresponding to the period of a frame, while the second gate start pulses have a phase delayed in turn by the first duration and the second duration according to frames. The gate driver includes n shift stage series circuits operating in response to the first gate start pulses, and a gate stage series circuit operating in response to the second gate start pulses.

Each time when one of the n pairs of gate lines GL11 to GL2*n* is enabled (i.e., during each period of the horizontal synchronization signal), the data driver 24 generates pixel data signal corresponding to a line of an image for the m data lines DL1 to DLm of the electro-luminescence panel 20. For this, the data driver 24 receives a line of pixel data VDl corresponding to a line of an image in response to a data control signal DCS. Then, the data driver 24 converts the line of pixel data VDl into an analog pixel data signal. In this way, m pixel data signals are generated and output through m output channels of the data driver 24 to the m data lines DL1 to DLm of the electro-luminescence panel 20.

The electro-luminescence display of FIG. 7 further includes m selectors MUL1 to MULm connected between the m output channels of the data driver 24 and the m data lines DL1 to DLm, respectively.

A refresh data signal RDS is commonly input to the m selectors MUL1 to MULm for maintaining a negative polarity voltage level of a constant level. The m selectors MUL1 to MULm operate in response to a polarity control signal POL so that a pixel data signal from a corresponding output channel of the data driver 24 and the refresh data signal RDS can be sequentially supplied to a corresponding data line DL of the electro-luminescence panel 20 at each pulse of a horizontal synchronization signal. The order of the pixel data signal and the refresh data signal RDS supplied to the data line DL varies from frame to frame. For example, when the polarity control signal POL has a predetermined logic level (i.e., a high logic level), the m selectors MUL1 to MULm allow pixel data signals to be supplied to data lines DL1 to DLm from the corresponding output channels of the data driver 24. On the other hand, when the polarity control signal PCS has a base logic level (i.e., a low logic level), the m selectors MUL1 to MULm supplies the refresh data signal to corresponding data lines DL.

The polarity control signal POL is reversed at each half period of a horizontal synchronization signal (or at a predetermined period of a horizontal synchronization signal). The order of base and high logic level sections of the polarity control signal POL may be changed in turn for each frame. Alternatively, the polarity control signal POL may have a base logic level for the first duration and a predetermined logic level for the second duration in turn. In this case, the order of the first and second durations can be changed on a frame-by-frame basis.

Due to operation of the m selectors MUL1 to MULm and the gate driver 22, the voltages of the first and second control nodes CN1 and CN2 (refer to FIG. 4) of the electro-luminescence pixel may be sequentially renewed at each frame. Therefore, the first and second thin film transistors MT11 and MT21 may operate in the active and refresh modes in a complementary manner, and the complementary operations of the first and second thin film transistors MT11 and MT21 are possible. Hence, although the electro-luminescence diode ELD of the electro-luminescence pixel continuously emits light according to the gray scale of a pixel image, the first and second thin film transistors MT11 and MT21 are less damaged.

As a result, the electro-luminescence panel 20 and the electro-luminescence display may have a longer life span. Furthermore, a residual image is not present or reduced on the electro-luminescence panel 20.

The electro-luminescence display of FIG. 7 further includes a timing controller 26 and a voltage generator 28. The timing controller 26 controls operation timing of the gate driver 22, the data driver 24, and the m selectors MUL1 to MULm. The voltage generator 28 generates voltages for driving electro-luminescence pixels of the electro-luminescence panel 20.

The timing controller 26 generates gate control signals GCSs, data control signals DCSs, and mix control signal MCSs using synchronization signals SYNCs received from an external unit (e.g., a graphic module of a computer system or an image modulation module of a television set). Furthermore, the timing controller 26 can receive frame pixel date VDf for each image frame from the external unit.

The frame pixel data VDf is divided into sets of a line of pixel data VDl corresponding to sets of a line of an image. The line pixel data VDl is supplied to the data driver 24. The timing controller 26 generates the refresh data signal RDS and supplies the refresh data signal RDS to the m selectors MUL1 to MULm for maintaining a negative polarity voltage level of a constant level.

The voltage generator 28 generates a first supply voltage having a high potential level and a second supply voltage having a low potential level for driving the electro-luminescence pixels of the electro-luminescence panel 20. The first supply voltage is commonly supplied to the electro-luminescence pixels of the electro-luminescence panel 20 through first voltage supply lines VDDs, and the second supply voltage is commonly supplied to the electro-luminescence pixels of the electro-luminescence panel 20 through second voltage supply line VSSs.

As described above, two driving thin film transistors operate complementarily in active and refresh modes for controlling an amount of current to an electro-luminescence diode in an electro-luminescence display according to the present invention. That is, when one of the two thin film transistors operates in the active mode, the other stays in the refresh mode. Therefore, the thin film transistors can be less damaged. Accordingly, the first and second thin film transistors MT11 and MT21, the electro-luminescence pixel including the first and second thin film transistors MT11 and MT21, the electro-luminescence panel including the electro-luminescence pixels, and the electro-luminescence display including the electro-luminescence panel can have longer life spans.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An electro-luminescence display having a plurality of pixels, one of the pixels of the display comprising:

an electro-luminescence diode electrically connected between first and second voltage sources;

first and second thin film transistors adjusting an amount of current flowing to the electro-luminescence diode; and a control circuit complementarily operating the first and second thin film transistors in an active mode and a refresh mode, wherein the control circuit includes a first control node electrically connected to a gate electrode of the first thin film transistor and a first storage capacitor, and a second control node electrically connected to a gate electrode of the second thin film transistor and a second storage capacitor.

2. The display according to claim 1, wherein the first and second thin film transistors are complementarily operated on a frame-by-frame basis.

3. The display according to claim 1, wherein the control circuit further includes a signal input unit complementarily applying a driving voltage to the first and second control nodes.

4. The display according to claim 3, wherein the signal input unit includes:

first and second data lines complementarily transmitting a data signal and a refresh signal;

a first switching transistor electrically connected between the first data line and the first control node; and a second switching transistor electrically connected between the second data line and the second control node.

5. The display according to claim 4, wherein the signal input unit further includes a gate line applying a scan signal to gate electrodes of the first and second switching transistors.

* * * * *